US006497522B2

(12) United States Patent
Wotton et al.

(10) Patent No.: US 6,497,522 B2
(45) Date of Patent: Dec. 24, 2002

(54) EDGE LIFT REDUCTION FOR BELT TYPE TRANSPORTS

(75) Inventors: Geoff Wotton, Battleground, WA (US); Robert M. Yraceburu, Camas, WA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/906,313

(22) Filed: Jul. 16, 2001

(65) Prior Publication Data

US 2001/0046404 A1 Nov. 29, 2001

Related U.S. Application Data

(63) Continuation-in-part of application No. 09/821,406, filed on Mar. 29, 2001, which is a continuation of application No. 09/550,854, filed on Apr. 17, 2000, now Pat. No. 6,254,092.

(51) Int. Cl.[7] ..... B41J 11/42; B41J 2/01; B41J 11/44; B65H 5/02; B65H 5/04

(52) U.S. Cl. ..... 400/578; 347/104; 271/276; 400/635

(58) Field of Search ..... 347/101, 102, 347/104; 271/276; 400/635, 648, 578

(56) References Cited

U.S. PATENT DOCUMENTS 6,336,722 B1 * 1/2002 Wotton et al. ..... 347/102
6,406,017 B1 * 6/2002 Yaneda ..... 271/276

* cited by examiner

*Primary Examiner*—John Barlow
*Assistant Examiner*—Alfred Dudding

(57) ABSTRACT

An ink-jet apparatus is disclosed having a vacuum type print media transport subsystem for moving the print media through a printing zone. A transport belt is provided with an array of perforations such that vacuum flow is restricted. The perforations only pass vacuum induced airflow through the belt when over vacuum ported platen regions. In an alternative embodiment, belt lifting is controlled and substantially eliminated via vacuum ports associated with non-perforated regions of the transport belt.

9 Claims, 5 Drawing Sheets

EDGE LIFT REDUCTION FOR BELT TYPE TRANSPORTS

CROSS-REFERENCE TO RELATED APPLICATIONS

This application is a continuation-in-part of U.S. patent application Ser. No. 09/821,406, filed Mar. 29, 2001, which is itself a continuation of U.S. patent application Ser. No. 09/550,854, filed Apr. 17, 2000 now U.S. Pat. No. 6,254,092.

STATEMENT REGARDING FEDERALLY SPONSORED RESEARCH OR DEVELOPMENT

Not Applicable.

REFERENCE TO AN APPENDIX

Not Applicable.

BACKGROUND OF THE INVENTION

1. Field of the Invention

The present invention relates generally to vacuum transport belt apparatus, such as useful in ink-jet hard copy apparatus and methods of operation and, even more specifically, to a vacuum transport belt system providing edge lift control and, preferably, substantial elimination of all edge lift.

2. Description of Related Art

It is known to use a vacuum induced force to adhere a sheet of flexible material to a surface, for example, transporting sheet metal, holding a sheet of print media temporarily to a transport system or platen, and the like. (Hereinafter, "vacuum induced force" is also referred to as "vacuum induced flow, "vacuum flow," or more simply as just "airflow," "vacuum" or "suction," as best fits the context.) Such vacuum holddown systems are a relatively common, economical technology to implement commercially and, in printing technology, can improve hard copy apparatus throughput specifications. For example, it is known to provide a rotating drum with holes through the surface wherein a vacuum type airflow through the chamber formed by the drum cylinder provides a suction force at the holes in the drum surface (see e.g., U.S. Pat. No. 4,237,466 for a PAPER TRANSPORT SYSTEM FOR AN INK JET PRINTER (Scranton) or U.S. Pat. No. 5,081,506 for a TRANSFER SYSTEM FOR A COLOR PRINTER (Borostyan)). (The term "drum" as used hereinafter is intended to be synonymous with any curvilinear implementation incorporating the present invention; while the term "platen" can be defined as a flat holding surface, in hard copy technology it is also used for curvilinear surfaces, e.g., the ubiquitous typewriter rubber roller; thus, for the purposes of the present application, "platen" is used generically for any shape paper holddown surface—stationary or movable—as used in a hard copy apparatus.) Permeable belts traversing a vacuum inducing support have been similarly employed (see e.g., Scranton and U.S. patent application Ser. No. 09/163,098 by Rasmussen et al. for a BELT DRIVEN MEDIA HANDLING SYSTEM WITH FEEDBACK CONTROL FOR IMPROVING MEDIA ADVANCE ACCURACY (assigned to the common assignee of the present invention and incorporated herein by reference)).

Generally in a hard copy apparatus implementation, the vacuum device is used either to support cut-sheet print media during transport to and from a printing station (also known as the "print zone" or "printing zone") of a hard copy apparatus, to hold the sheet media at the printing station while images or alphanumeric text are formed, or both. (In order to further simplify description of the technology and invention, the term "paper" is used hereinafter to refer to all types of print media and the term "printer" to refer to all types of hard copy apparatus; no limitation on the scope of the invention is intended nor should any be implied.)

In essence, the ink-jet printing process involves digitized, dot-matrix manipulation of drops of ink, or other liquid colorant, ejected from a pen onto an adjacent paper. One or more ink-jet type writing instruments (also referred to in the art as an "ink-jet pen" or "print cartridge") include a printhead which generally consists of drop generator mechanisms and a number of columns of ink drop firing nozzles. Each column or selected subset of nozzles (referred to in the art as a "primitive") selectively fires ink droplets (typically each being only a few picoliters in liquid volume) that are used to create a predetermined print matrix of dots on the adjacently positioned paper as the pen is scanned across the media. A given nozzle of the printhead is used to address a given matrix column print position on the paper (referred to as a picture element, or "pixel"). Horizontal positions, matrix pixel rows, on the paper are addressed by repeatedly firing a given nozzle at matrix row print positions as the pen is scanned. Thus, a single sweep scan of the pen across the paper can print a swath of dots. The paper is stepped to permit a series of contiguous swaths. Dot matrix manipulation is used to form alphanumeric characters, graphical images, and even photographic reproductions from the ink drops. Page-wide ink-jet printheads are also contemplated and are adaptable to the present invention.

A well-known phenomenon of wet-colorant printing is "paper cockle," the irregular surface produced in paper by the saturation and drying of ink deposits on the fibrous medium. As a sheet of paper gets saturated with ink, the paper grows and buckles in a seemingly random manner. Paper printed with images are more saturated with colorant than simple text pages and thus exhibit great paper cockle. Colors formed by mixing combinations of other color ink drops form greater localized saturation areas and also exhibit greater cockle tendencies.

As the ink-jet writing instruments—often scanning at a relatively high rate across the paper—expel minute droplets of ink onto adjacently positioned print media and sophisticated, computerized, dot matrix manipulation is used to render text and form graphic images, the flight trajectory of each drop is critical to print quality. Printing errors (also referred to in the art as "artifacts") are induced or exacerbated by any airflow in the printing zone. Thus, use of a vacuum platen and vacuum transport device in the printing zone of an ink-jet printer creates an added difficulty for the system designer. One solution to the problem is set out in common assignee's pending application U.S. patent application Ser. No. 09/514,830, filed on Feb. 28, 2000, for a LOW FLOW VACUUM PLATEN FOR AN INK-JET HARD COPY APPARATUS. In essence, it employs a platen having an array of vacuum ports that are each filtered. The filter is constructed to provide restricted airflow such that media holddown pressure remains substantially uniform when the platen is either fully covered or partially uncovered. The filter mechanism provides airflow restrictions such that ink drop flight trajectories in the printing zone are unaffected, acoustic dampening of the vacuum pump is provided, and vacuum pressure is kept relatively high at the print media edges.

Moreover, in general there has been found that a problem exists where near the side edges of the vacuum transport belt lifting of the belt off the subjacent platen occurs. The higher the speed of the belt, the larger the dimensions of the belt, the greater the problem. The problem has been found to be most egregious at any cross-belt seam(s). For a printer, the problem is that if the belt lifts from the platen along the belt side edges, the pen-to-paper must be increased to prevent the pen from catching which could damage the belt and possibly damage or destroy the pen. At the same time, to improve throughput, it is advantageous to have the belt move as quickly as possible to off-load a printed sheet and advance a next sheet to the print zone. Moreover, if a heated platen is employed to assist in drying ink on the transported media in either or all of the pre-print, print, and post-print zones, lifting of the belt can interrupt conductive heating via the belt to the media. One common known manner solution is to provide physical edge guides. However, this adds piece part to manufacture, increasing cost and complexity.

There is still a need for a commercial, low-cost, vacuum system for use in an ink-jet printing zone which will assist in minimizing cockle and provide a minimal airflow impact on ink-jet drop flight trajectory. There is a further need for a vacuum system for controlling and substantially eliminating belt edge lifting.

BRIEF SUMMARY OF THE INVENTION

In its basic aspect, the present invention provides a vacuum platen system for transporting a sheet material, including: a platen having first ports permitting airflow therethrough at predetermined positions of a surface thereof; a vacuum device associated with the platen and inducing the airflow; and a transport belt superjacent the surface, having an array of belt perforations and non-perforated belt side margins, wherein said platen has at least one elongated second port subjacent each of said margins.

In another aspect, the present invention provides a method for transporting print media across a vacuum platen associated with a vacuum inducing mechanism, the method including: drawing a vacuum through a plurality of vacuum ports distributed across the platen; transporting ink-jet print media across the platen in a predetermined direction by a belt associated with the platen, the belt having a perforated central region and non-perforated side margin regions; and drawing the vacuum against said side margin regions such that lifting of said belt during transport across said platen is substantially eliminated.

In another aspect, the present invention provides a vacuum platen adapted for association with a vacuum source and a partially perforated transport belt, the platen including: at least one central region having a plurality of first vacuum ports associated with providing vacuum to at least one adjacent central region of the perforated transport belt; and at least marginally located second vacuum ports associated with providing vacuum to non-perforated regions of the transport belt.

Another aspect of the present invention is an ink-jet hard copy apparatus including: an ink-jet writing instrument associated with a printing zone within the apparatus; an endless loop vacuum belt system for transporting print media to and from the printing zone; and a vacuum platen system located proximate the printing zone, the vacuum platen system having a platen, having a plurality of vacuum ports therethrough, a vacuum chamber, and a vacuum device for maintaining a negative pressure within the chamber such that an airflow is established through the vacuum ports into the chamber, wherein the vacuum belt system has a belt having a perforated central region and non-perforated side margins, and said platen system has at least two side margin vacuum ports, each of said side margin vacuum ports subjacent to said non-perforated side margins of said belt.

The foregoing summary is not intended to be an inclusive list of all the aspects, objects, advantages, and features of the present invention nor should any limitation on the scope of the invention be implied therefrom. This Summary is provided in accordance with the mandate of 37 C.F.R. 1.73 and M.P.E.P. 608.01(d) merely to apprise the public, and more especially those interested in the particular art to which the invention relates, of the nature of the invention in order to be of assistance in aiding ready understanding of the patent in future searches. Objects, features and advantages of the present invention will become apparent upon consideration of the following explanation and the accompanying drawings, in which like reference designations represent like features throughout the drawings.

The drawings referred to in this specification should be understood as not being drawn to scale except if specifically annotated.

DETAILED DESCRIPTION OF THE INVENTION

Reference is made now in detail to a specific embodiment of the present invention, which illustrates the best mode presently contemplated by the inventors for practicing the invention. Alternative embodiments are also briefly described as applicable.

Figure 1:
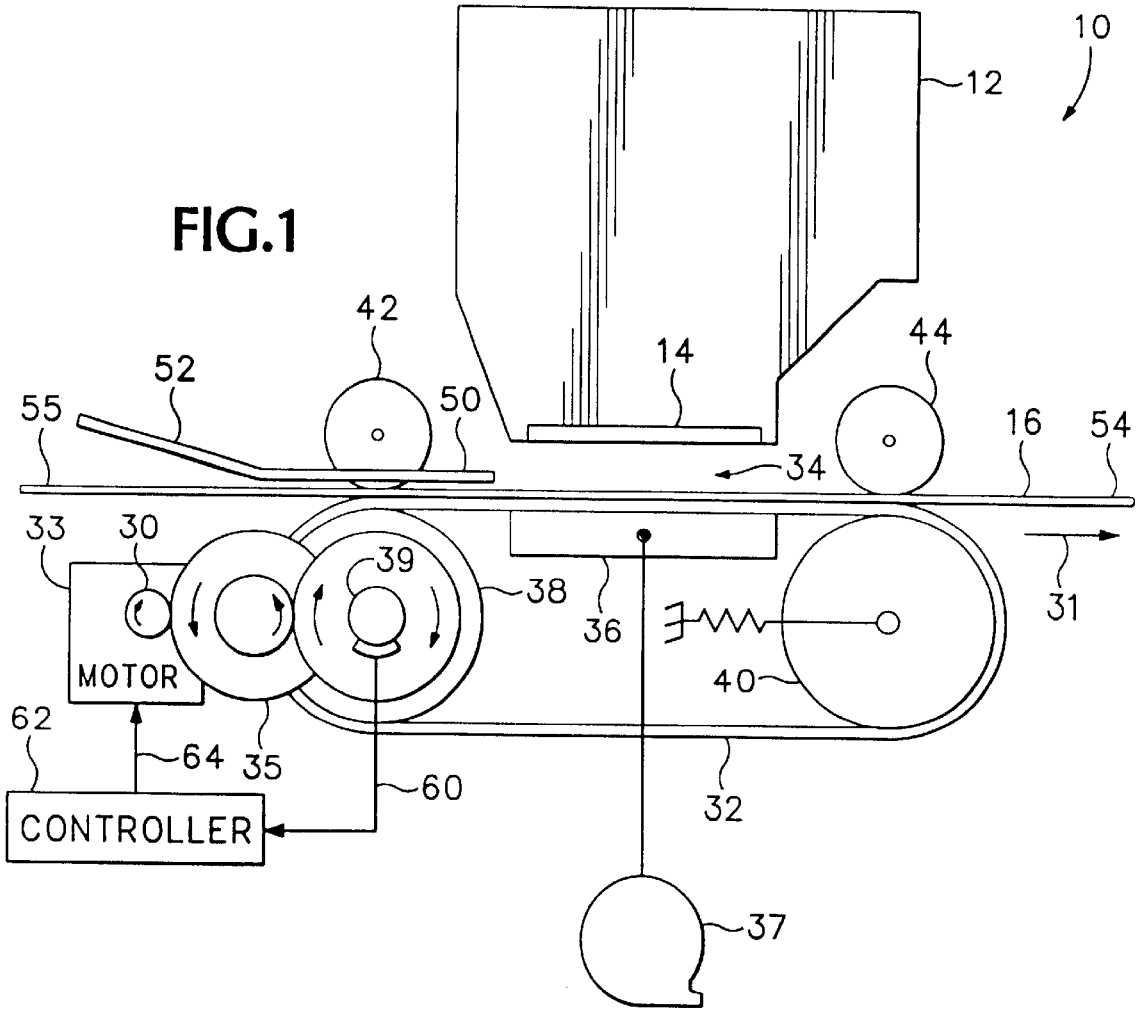
FIG. 1 is a schematic illustration of an ink-jet hard copy apparatus in accordance with the present invention.

FIG. 1 is a schematic depiction of an exemplary embodiment of an ink-jet hard copy apparatus 10 in accordance with the present invention. A writing instrument 12 is provided with a printhead 14, having drop generators including nozzles for ejecting ink droplets onto an adjacently positioned print medium, e.g., a sheet of paper 16, in the apparatus' printing zone 34.

One type of printing zone input-output paper transport, and a preferred embodiment for the present invention, is an endless-loop belt 32 subsystem. A motor 33 having a drive shaft 30 is used to drive a gear train 35 coupled to a belt pulley 38 mounted on a fixed axle 39. A biased idler wheel 40 provides appropriate tensioning of the belt 32. The belt rides over a generic platen 36 in the print zone 34; a specific platen subsystem in accordance with the present invention is described in detail hereinafter, but in general the vacuum platen subsystem is associated with a known manner vacuum induction system 37 (for simplicity of description referred to hereinafter sometimes as merely a "pump"). The paper sheet 16 is picked from an input supply (not shown) and its leading edge 54 is delivered to a guide 50, 52 aligned for delivering a leading edge to the belt; an optional pinch wheel 42 in contact with the belt 32 may be used to assist transport of the paper sheet 16 through the printing zone 34 (the paper path is represented by arrow 31). While vacuum release through the belt 32 downstream of the printing zone 34 (viz., off-platen) may be sufficient to transport the sheet 16 leading edge 54 toward the apparatus=output, an output roller 44 in contact with the belt 32 may optionally be used to receive the leading edge of the paper sheet and continue the paper transport until the trailing edge 55 of the now printed page is released.

Figure 2:
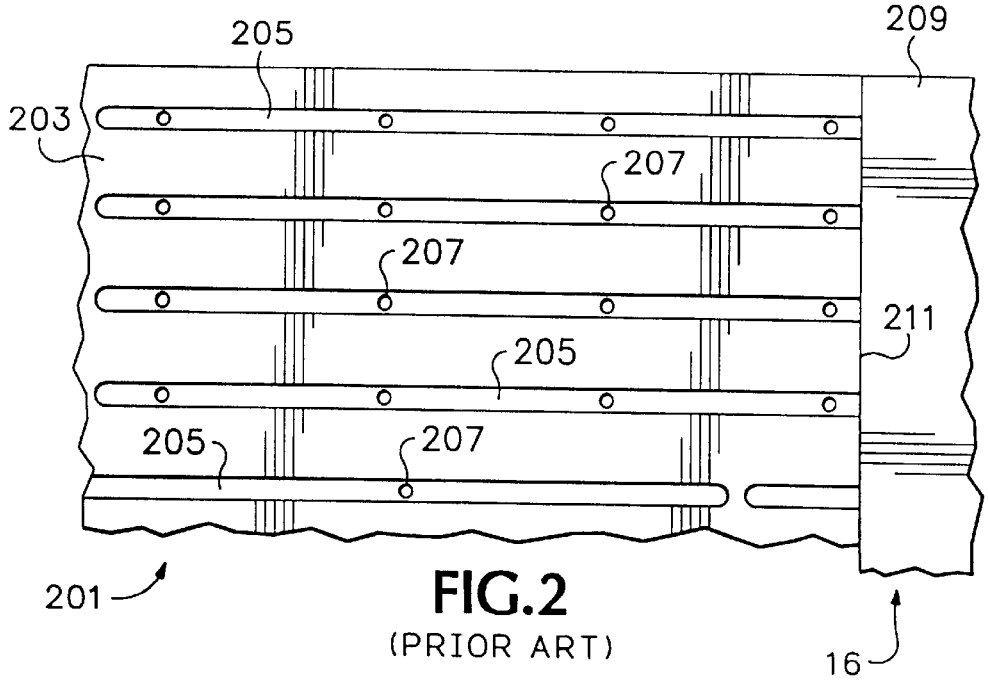
FIG.2 (PRIOR ART)
FIG. 2 (Prior Art) is a planar, overhead view of detail of the top surface of a vacuum platen.

Referring to both FIG. 1 and FIG. 2 (Prior Art), a specific type of channeled platen 201 is illustrated. This platen 201 has a top surface 203 over which the belt 32 slides. Slots 205 in the surface 203 are coupled to the subjacent vacuum induction system 37 by through-holes 207 to distribute the vacuum force across the platen 201 to hold the sheet of paper 16. A region 209 of the sheet of paper 16 is shown covering part of the surface 203 area. When a slot 205 is fully or partially open, as shown, airflow is high through the holes 207 of that slot 205 since the region 209 of paper is not closing the entire slot off from the local atmosphere. This can cause several problems. For example, the airflow into the vacuum box is high for smaller media sheets that leave a large percentage of the platen surface 203 open. This requires a relatively large vacuum pump 37. If the surface 203 is mostly open (e.g., when a 3×5 inch card is on a 12×16-inch platen such that there is only about eight percent platen coverage), the pump 37 must provide a very large flow (e.g., 200 CFM or greater) before the appropriate vacuum level (e.g., at least 6-inches $H_2O$) is produced in the slots 205 beneath the card. A large vacuum pump is undesirable since it leads to noise problems and increased cost of manufacture. The use of smaller holes 207 weakens vacuum levels in partially open slots 205 and leads to still other problems as smaller holes tend to clog with ink and paper dust. High airflow is induced around the edge 211 of the paper 209 also disturbs ink droplet flight trajectory from the pen 12 (FIG. 1 only) to the paper. Moreover, the vacuum force exerted on the underside of the paper 209 is diminished in partially open slots which might permit undesirable paper flexing, cockle, or motion during a printing cycle.

Figure 3:
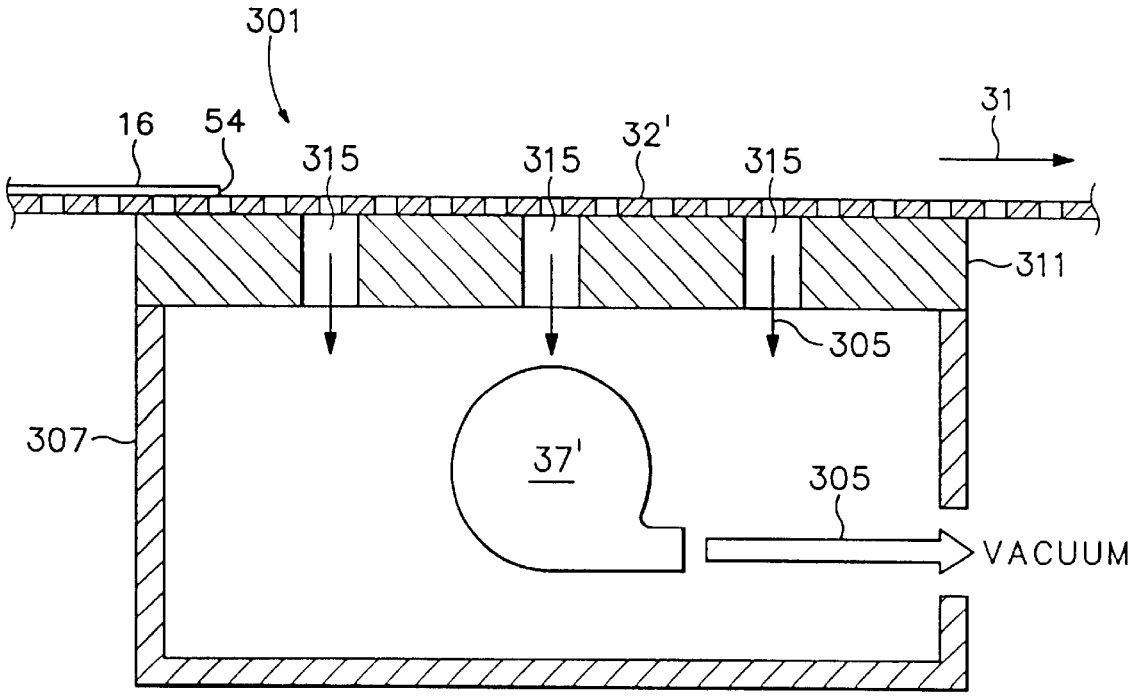
FIG. 3 is a schematic depiction of a vacuum platen system used in the present invention as also shown in FIG. 1.

Referring now to both FIGS. 1 and 3, illustrations of the details of the vacuum platen subsystem 301 for the hard copy apparatus 10 are shown. The system 301 fundamentally substitutes in the printing zone 34 of FIG. 1 for elements 36 and 37. Electrical power is supplied in any known manner; further details are not required for an understanding of the present invention.

A pump or exhaust mechanism 37' is mounted in any known manner in a vacuum box 307 (correlates in general position to FIG. 1, element 36). A sheet 16 of paper is transported along paper path 31 to the printing zone by a perforated transport belt 32'. A platen 311 member is mounted atop the vacuum box 307. The platen 311 has a plurality of vacuum passageways, or ports, 315 coupling its outer surface with the vacuum source. The vacuum flow through the platen 311 and vacuum box 307 is represented by the arrows 305. While in the shown embodiment it has been found that incorporating the pump 37' into the vacuum box 307 provides a commercially viable arrangement, it will be apparent to those skilled in the art that the vacuum pump can be remotely located in the printer 10 and coupled to the vacuum box if known manner manifolding is provided.

Figure 4:
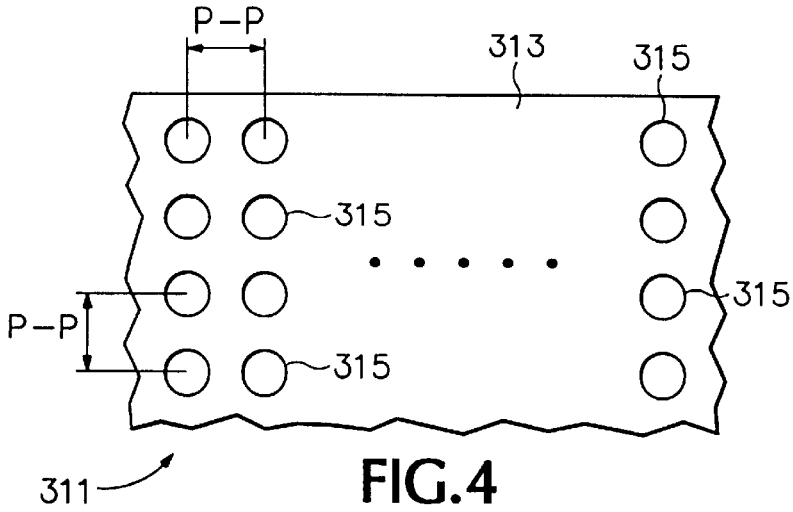
FIG.4 (PRIOR ART)
FIG. 4 (Prior Art) is an overhead view illustration of an exemplary platen surface have vacuum ports therethrough.

Turning also to FIG. 4, one embodiment of a substantially flat platen 311, has a surface 313 that has vacuum ports 315 distributed across the surface. The distribution pattern can vary depending on the design specifics of a particular implementation. In the exemplary embodiment shown, the ports 315 comprise a linear array of substantially circular apertures. In a preferred embodiment, each port has a diameter which is essentially greater than that of perforations in the belt 32 which will ride over it as shown in FIG. 1 and which are separated by a port-to-port distance, "P-P," a distance substantially greater than the distance between the perforations in the belt by a predetermined factor, generally at least double. In general, it is preferable that the platen vacuum ports 315 be large enough so that they do not clog with ink or paper dust or an aerosol mixture of the two. Ports 315 having a diameter in the approximate range of two to seven (2–7) millimeters have been found to be suitable to ink-jet printing conditions.

Figures 5, 5A:
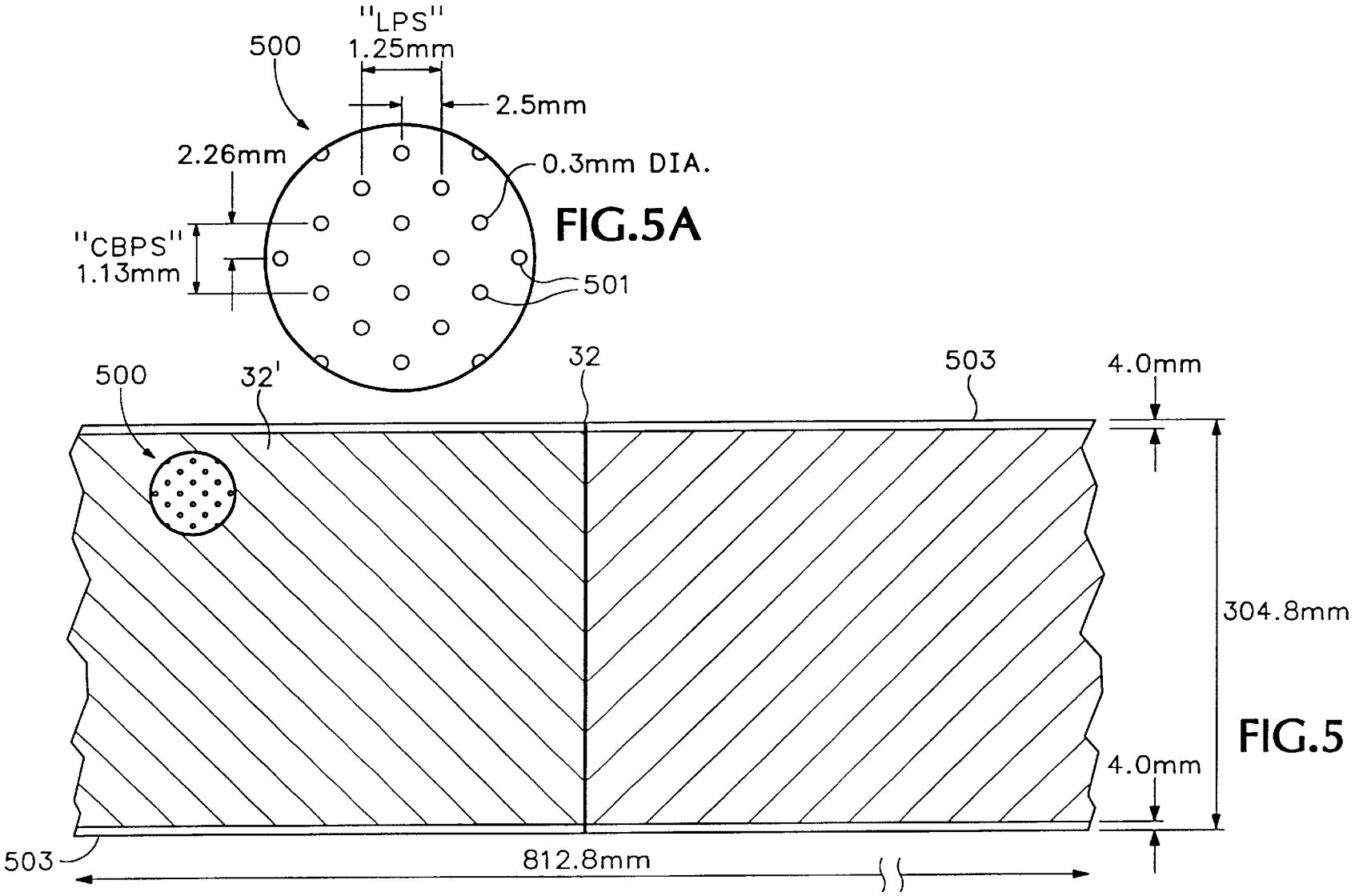
FIGS. 5, 5A is a schematic illustration (overhead view) of a section of a preferred embodiment of an endless-loop belt section in accordance with the present invention.

FIGS. 5 and 5A illustrate a preferred embodiment for a perforated metal belt 32'. Preferably, the belt 32' is fabricated of INVAR™tm (commercially available from Specialty Steel and Forge company of Fairfield, N.J.), having a thickness of approximately 0.005-inch, which makes it suitably flexible for a printer 10 (FIG. 1). Other flexible metal, plastic, and fabric materials may be employed. The belt can be coated with PTFE, a nickel-PTFE blend, or any other commercial low friction substance in order to reduce drag forces and wear as the belt passes over the platen 311. A thirty-two inch endless loop by twelve inch width implementation is a preferred embodiment for use with commercially available papers up to B-size; it will be recognized by those skilled in the art that any specific implementation may vary. An array 500 of individual belt perforations 501 is provided for transmitting the vacuum 305 from the platen 311 (see FIG. 3) through the belt to its outer surface 32'.

For the platen 311 construct embodiment as shown in FIG. 4, the array 500 of perforations 501 is shown to be a staggered array and to have a cross-belt perforation separation, "CBPS," of approximately 1.13-mm and a longitudinal perforation separation "LPS" of approximately 1.25-mm. Each perforation 501 has a diameter of approximately 0.3-mm. The array 500 of perforations 501 stops at border regions 503 of the belt 32 to ensure that the integrity of the entire belt is not compromised by perforations too near the edge. In the shown embodiment, an approximate 4.0-mm wide border region 503 is provided along each longitudinal edge of the belt 32'.

With the belt perforation array 500 as shown in FIGS. 5 and 5A and the platen port construct as illustrated in FIG. 4, the perforations 501 only allow the passage of air through them when they are over platen ports 315. In other words, the design is tailored so that a sufficient flow through the belt is provided to limit wet paper positional changes and deformations yet low such that ink droplet trajectories are not affected and other problems related to the use of vacuum (see Background section above) are minimized.

It will also be recognized by those skilled in the art that in an alternative embodiment the ports may open into vacuum channels across the platen surface 313. Such an arrangement is known to provide a more uniform vacuum across the width of the platen. See e.g., U.S. patent application Ser. No. 09/292,838 by Wotton et al. for a VACUUM SURFACE FOR WET DYE HARD COPY APPARATUS (assigned to the common assignee herein and incorporated herein by reference).

Figure 6:
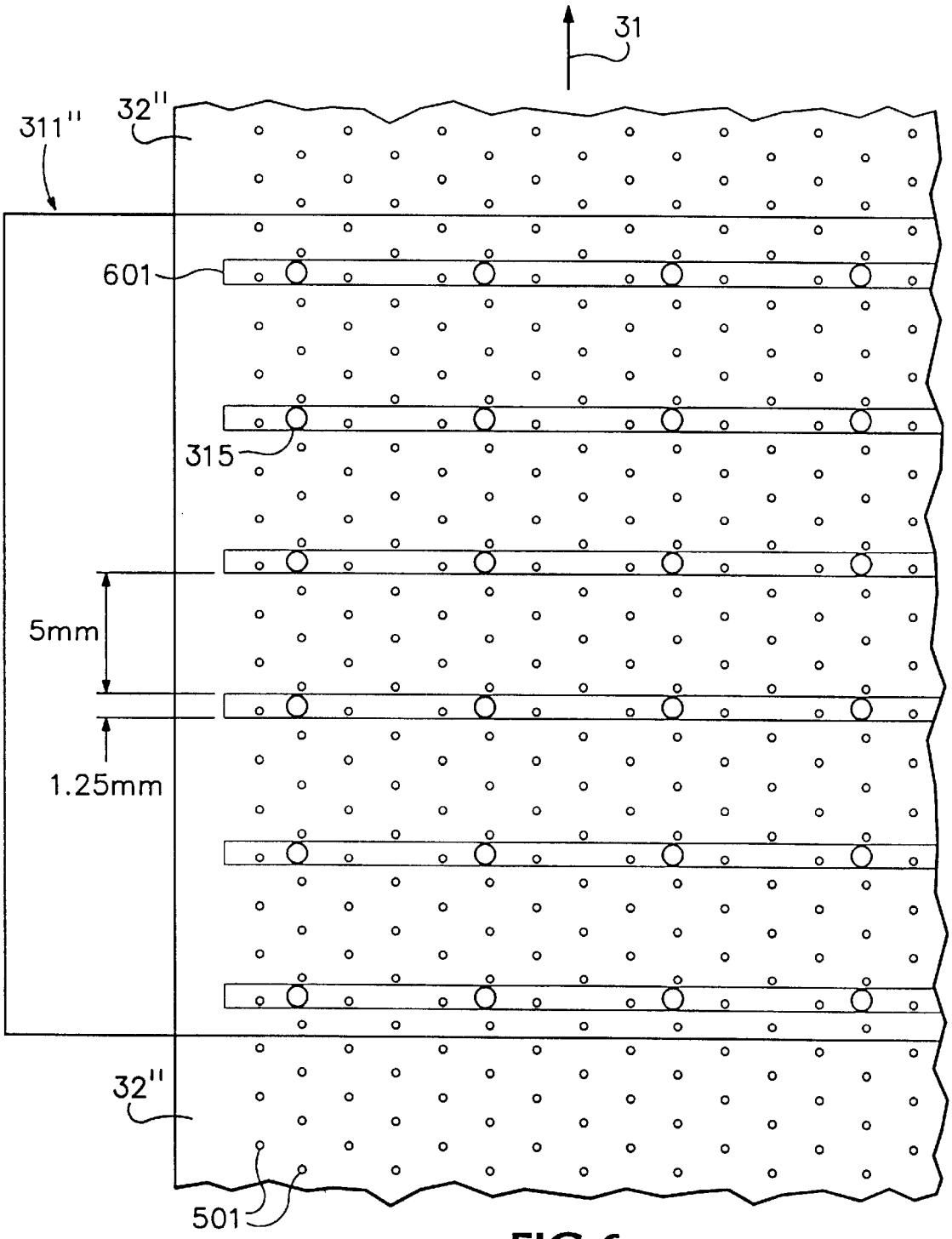
FIG. 6 is a schematic illustration (overhead view) of a section of a preferred embodiment of an endless-loop belt section (in transparency) riding over a section of a preferred embodiment of a channeled vacuum platen in accordance with the present invention for a hard copy apparatus as shown in FIG. 1.

FIG. 6 depicts a preferred embodiment combination of perforated belt 32" and platen 311' that has ported channels 601. The belt 32" section is shown as transparent so that the subjacent platen 311" details are evident. A vacuum flow rate of approximately 33 cubic feet/hour/square inch is preferred. A vacuum flow rate in the range of about 6.0 to 103 cubic feet per hour per square inch should be employed. A vacuum induction force equivalent to about 8-inches-water-column provided beneath the platen 311" is preferred. Vacuum force in the range of 3-inches-water-column to 50-inches-water-column can be employed.

A series of platen channels 601 in the platen 311", each having a depth of about 0.5-mm and width of about 1.25-mm, separated from each other by about 5.0-mm in the paper path 31 direction, are oriented to be perpendicular to the transport belt motion, paper path 31 (FIG. 1). A set of vacuum ports 315 through the floor of each channel 601 have a diameter of just slightly less than the channel width. The ports 315 within a channel 601 are separated by about 7-mm. As in FIG. 5A, a staggered array 500 of perforations 501 through the belt 32" are provided. The relative belt porosity is only about 2.5 percent. The relative platen porosity is about 20 percent. Thus, the total subsystem porosity is about one-half of one percent (0.50%). The total suited porosity is in the approximate range of twelve-hundredths to two percent (0.12% to 2.0%). The suited belt porosity is in the approximate range of twelve-hundredths to twenty percent (0.12% to 20%). The suited platen porosity is in the approximate range of ten to over ninety percent (10% to over 90%). The belt 32, 32', 32" is providing the requisite flow restriction; therefore, the platen air flow passages 315 can be relatively large and close together without having an excessively large airflow affecting drop trajectory, pump requirements, and the like as discussed in the Background section above. Larger platen holes are less likely to clog and increased packing density can provide a vacuum closer to media edges. The area of each air flow passage 315 through the platen 311, 311' should be substantially greater than the combined area of all air passages through the belt 32, 32', 32" that couple the vacuum flow 305 to the paper transport surface of the belt. If not, a significant pressure drop will occur through the platen air passages. If a platen air flow passage 315 is approximately five times as great as the associated belt holes combined area, then the pressure drop through the platen will be approximately four percent (4%) of the pressure drop through the belt. It is preferable that at least 75% of the pressure drop occurs through the belt.

In another envisioned embodiment, the vacuum belt may be suspended across a vacuum source having essentially no physical support of the belt in the printing zone, providing appropriate flow restriction there by controlling the areal density of perforations in the belt based on the specific implementation's design parameters and intended media usage. FIG. 5A provides an exemplary implementation.

Thus, the present invention provides an ink-jet apparatus 10 with a vacuum type print media transport subsystem 301 for moving the print media 16 through a printing zone 34. A transport belt 32 is provided with an array 500 of perforations 501 such that vacuum flow 305 is restricted. The perforations only pass a limited vacuum induced airflow 305 through the belt when over a platen 311 port 315.

It will be recognized by those skilled in the art that while the present invention has been illustrated in a substantially planar embodiment, the concept is applicable to curvilinear platen implementation, including vacuum drum designs where the platen and vacuum box are concentric constructs.

Figure 7:
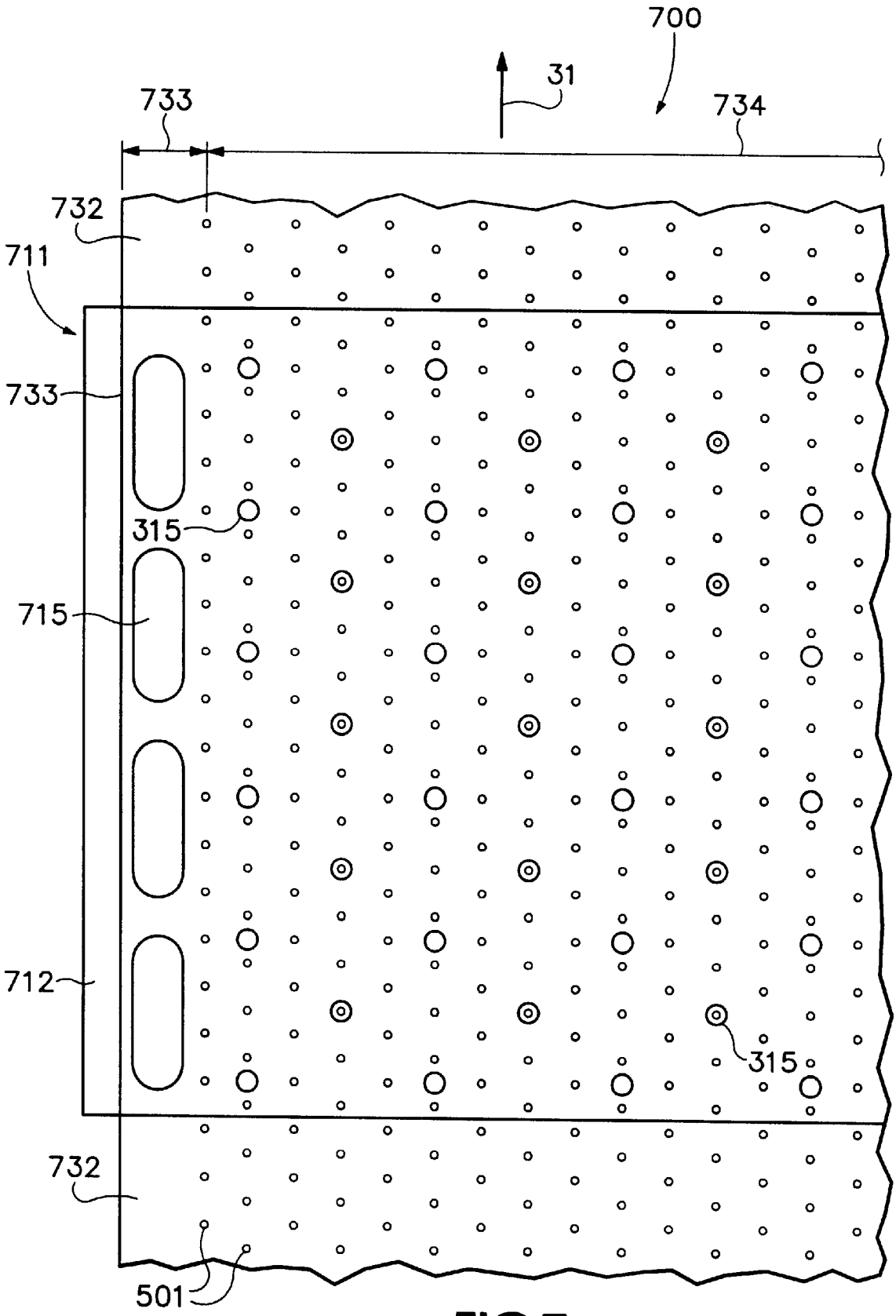
FIG. 7 is an alternative embodiment of the present invention, providing belt edge lift control.

Turning to FIG. 7, an alternative embodiment of a system 700 in accordance with the present invention provides belt 732 (analogous to belt 32" as shown in previous FIGURES) side edge lift control. Again, the belt 732 is generally moving in the direction indicated by arrow 31 across the platen 711 (cross channels 601, FIG. 6, have been deleted for simplifying the description of this embodiment, but may be employed). Belt side edge(s) 733, absent the present invention, are subject to lifting from the belt-abutting platen surface 712 as the belt 732 slides over it. In accordance with the present invention elongated platen apertures 715 are provided, coupling the vacuum 305 (FIG. 3) to the surface 712 and the superjacent, non-perforated, belt side margin 733. Note that the vacuum through the elongated platen apertures 715 are substantially leak-free as they are in constant contact with the non-perforated margin 733 of the belt 732. Therefore, there is no increase in pump 37 power and suction requirements. Since there is no vacuum flow under the margin 733, the platen can have unrestricted airflow, eliminating the need for any aperture 715 flow control elements; if the belt 732 starts to lift, high vacuum-induced airflow 305 (FIG. 3) will suck the margin 733 back down onto the platen surface 712 as predicted by Bernoulli's flow equations.

In a preferred implementation, the belt perforations 501 have a diameter in the approximate range of 0.1 mm to 1.0 mm; the first vacuum ports 315 subjacent the perforated central region 734 of the belt 732 have a diameter in the approximate range of 0.7 mm to 5 mm; and, the elongated ports 715 have dimensions of approximately 5 mm wide by 15 mm tall. Other geometric shapes of elongated ports, squares, rectangles, ovoids, and the like, may be employed within the scope of the invention. Note also that the embodiments of FIGS. 2, 3 and 4 can also have belt edge vacuum hold down in accordance with the present invention.

For implementations where belt lift is a problem in other regions than the side margin, appropriate subjacently positioned elongated vacuum ports 715 can be provided; e.g., in a large paper plotter using D-size or E-size media, centrally located non-perforated belt strips and subjacent elongated vacuum ports.

The foregoing description of the preferred embodiment of the present invention has been presented for purposes of illustration and description. It is not intended to be exhaustive or to limit the invention to the precise form or to exemplary embodiments disclosed. Obviously, many modifications and variations will be apparent to practitioners skilled in this art. Similarly, any process steps described might be interchangeable with other steps in order to achieve the same result. The embodiment was chosen and described in order to best explain the principles of the invention and its best mode practical application, thereby to enable others skilled in the art to understand the invention for various embodiments and with various modifications as are suited to the particular use or implementation contemplated. It is intended that the scope of the invention be defined by the claims appended hereto and their equivalents. Reference to an element in the singular is not intended to mean "one and only one" unless explicitly so stated, but rather means "one or more." Moreover, no element, component, nor method step in the present disclosure is intended to be dedicated to the public regardless of whether the element, component, or method step is explicitly recited in the following claims. No claim element herein is to be construed under the provisions of 35 U.S.C. Sec. 112, sixth paragraph, unless the element is expressly recited using the phrase "means for . . . " and no process step herein is to be construed under those provisions unless the step or steps are expressly recited using the phrase "comprising the step(s) of . . . ".

What is claimed is:

1. A vacuum platen system for transporting a sheet material, comprising:

a platen having first ports permitting airflow therethrough at predetermined positions of a surface thereof;

a vacuum device associated with the platen and inducing the airflow; and a transport belt superjacent the surface, having an array of belt perforations and non-perforated belt side margins, wherein said platen has at least one elongated second port subjacent each of said margins.

2. The system as set forth in claim 1 comprising:

the belt perforations have a diameter in the approximate range of 0.1 mm to 1.0 mm;

the first ports have a diameter in the approximate range of 0.7 mm to 5.0 mm; and the elongated ports have dimensions of approximately 5.0 mm by 15 mm.

3. The system as set forth in claim 1 wherein the perforations have a diameter less than first port diameters and second port dimensions.

4. A method for transporting print media across a vacuum platen associated with a vacuum inducing mechanism, the method comprising:

drawing a vacuum through a plurality of vacuum ports distributed across the platen;

transporting ink-jet print media across the platen in a predetermined direction by a belt associated with the platen, the belt having a perforated central region and non-perforated side margin regions; and drawing the vacuum against said side margin regions such that lifting of said belt during transport across said platen is substantially eliminated.

5. The method as set forth in claim 4, the drawing the vacuum against said side margin regions comprising:

drawing the vacuum via at least one elongated vacuum port through said platen subjacent said side margin regions.

6. A vacuum platen adapted for association with a vacuum source and a partially perforated transport belt, the platen comprising:

at least one central region having a plurality of first vacuum ports associated with providing vacuum to at least one adjacent central region of the perforated transport belt; and at least marginally located second vacuum ports associated with providing vacuum to non-perforated regions of the transport belt.

7. The platen as set forth in claim 6 wherein belt perforations have a diameter in the approximate range of 0.1 mm to 1.0 mm, the platen comprising:

the first vacuum ports have a diameter in the approximate range of 0.7 mm to 5.0 mm, and the second vacuum ports have dimensions of approximately 5.0 mm by 15 mm.

8. An ink-jet hard copy apparatus comprising:

an ink-jet writing instrument associated with a printing zone within the apparatus;

an endless loop vacuum belt system for transporting print media to and from the printing zone; and a vacuum platen system located proximate the printing zone, the vacuum platen system having a platen, having a plurality of vacuum ports therethrough, a vacuum chamber, and a vacuum device for maintaining a negative pressure within the chamber such that an airflow is established through the vacuum ports into the chamber, wherein the vacuum belt system has a belt having a perforated central region and non-perforated side margins, and said platen system has at least two side margin vacuum ports, each of said side margin vacuum ports subjacent to said non-perforated side margins of said belt.

9. The apparatus as set forth in claim 8 wherein said side margin vacuum ports have a geometry associated with geometries of said belt for preventing edge lift of said belt off said platen.

* * * * *